US009045892B2

(12) United States Patent
Smith et al.

(10) Patent No.: US 9,045,892 B2
(45) Date of Patent: Jun. 2, 2015

(54) BRICK VENEER HEADER BRACKET

(71) Applicants: M. Clay Smith, Elizabethtown, KY (US); Paul J. Spalding, West Point, KY (US)

(72) Inventors: M. Clay Smith, Elizabethtown, KY (US); Paul J. Spalding, West Point, KY (US)

( * ) Notice: Subject to any disclaimer, the term of this patent is extended or adjusted under 35 U.S.C. 154(b) by 0 days.

(21) Appl. No.: 13/998,982

(22) Filed: Dec. 30, 2013

(65) Prior Publication Data

US 2014/0215956 A1 Aug. 7, 2014

Related U.S. Application Data

(60) Provisional application No. 61/848,273, filed on Dec. 29, 2012.

(51) Int. Cl.

| | |
|---|---|
| ***E04B 1/38*** | (2006.01) |
| ***E04C 5/00*** | (2006.01) |
| ***E04B 1/00*** | (2006.01) |
| ***E04B 1/04*** | (2006.01) |
| ***E04B 1/26*** | (2006.01) |
| *E04B 1/24* | (2006.01) |

(52) U.S. Cl.

CPC . *E04B 1/003* (2013.01); *E04B 1/38* (2013.01); *E04B 1/043* (2013.01); *E04B 1/2612* (2013.01); *E04B 2001/2415* (2013.01); *E04B 2001/2644* (2013.01)

(58) Field of Classification Search

CPC ..... E04B 1/38; E04B 1/003; E04B 1/18; E04B 1/2612; E04B 2001/2415; E04B 2001/2463; E04B 1/043

USPC ..... 52/712, 713, 714, 715, 289, 73, 698, 52/92.2, 489.1, 742.15, 702; 403/232.1; D8/349, 394; 269/41

See application file for complete search history.

(56) References Cited

U.S. PATENT DOCUMENTS

| | | | | |
|---|---|---|---|---|
| 1,720,104 | A | | 7/1929 | Taylor |
| 1,813,044 | A | * | 7/1931 | Franks ..... 52/289 |
| 3,003,600 | A | * | 10/1961 | Mackenzie ..... 52/633 |
| 3,350,830 | A | * | 11/1967 | Smith, Jr. et al. ..... 52/509 |
| 4,021,991 | A | * | 5/1977 | Hotz ..... 403/388 |
| 4,198,175 | A | * | 4/1980 | Knepp et al. ..... 403/191 |
| 4,527,375 | A | | 7/1985 | Braginetz |
| 4,584,813 | A | | 4/1986 | Hudson |
| 4,811,542 | A | | 3/1989 | Jewell |
| 4,953,339 | A | | 9/1990 | Jewell |
| 5,058,358 | A | | 10/1991 | Stratton |
| 5,513,476 | A | * | 5/1996 | Jones ..... 52/713 |
| D376,749 | S | | 12/1996 | Hertzog |
| 5,611,179 | A | * | 3/1997 | Leek ..... 52/293.3 |
| 5,673,903 | A | | 10/1997 | Lewis |
| 5,746,421 | A | | 5/1998 | Bowerman |

(Continued)

*Primary Examiner* — Chi Q Nguyen

(74) *Attorney, Agent, or Firm* — Carrithers Law Office, PLLC

(57) ABSTRACT

A header bracket for connecting a deck ledger board to the side of a house and thus connecting the deck to the house, especially a brick veneer house. The bracket is first connected to a house rim board or the concrete foundation. The bracket is configured to extend through the outside covering of the house, whether the covering be siding, stucco, brick veneer or some other covering. The deck ledger board is attached to the end of the bracket opposite of the end which is connected to the house. The deck is now built as normal by first connecting deck joists which are supported at one end by the ledger board and at the opposite end by posts. The length of the bracket is adjustable to provide for different thicknesses of siding or brick. The header bracket is capable of being assembled in either a U-shaped or a Z-shaped configuration.

8 Claims, 4 Drawing Sheets

(56) References Cited

U.S. PATENT DOCUMENTS

| | | | | |
|---|---|---|---|---|
| 5,836,131 | A * | 11/1998 | Viola et al. | 52/702 |
| 6,311,449 | B1 | 11/2001 | Morse | |
| 6,397,552 | B1 | 6/2002 | Bourque | |
| 6,427,391 | B1 | 8/2002 | Lyons | |
| 6,463,710 | B1 | 10/2002 | Barnhart | |
| 6,470,644 | B2 * | 10/2002 | James et al. | 52/745.06 |
| 6,612,087 | B2 * | 9/2003 | diGirolamo et al. | 52/712 |
| 6,635,083 | B1 * | 10/2003 | Cheng et al. | 623/1.15 |
| 6,817,157 | B2 | 11/2004 | Bourque | |
| 7,254,926 | B2 | 8/2007 | Eldeen | |
| 7,334,372 | B2 | 2/2008 | Evans | |
| 7,712,283 | B2 | 5/2010 | Gadd | |
| 7,886,494 | B1 | 2/2011 | Schott | |
| 8,607,515 | B2 * | 12/2013 | Jarvis | 52/253 |
| 2005/0066613 | A1 | 3/2005 | Bourque | |
| 2005/0155314 | A1 | 7/2005 | Banta | |
| 2005/0160683 | A1 | 7/2005 | Eldeen | |
| 2006/0130414 | A1 | 6/2006 | Walther | |
| 2009/0025309 | A1 | 1/2009 | Deans | |
| 2010/0307094 | A1 | 12/2010 | Spyrou | |
| 2011/0277392 | A1 | 11/2011 | Morsching | |
| 2014/0144098 | A1 * | 5/2014 | Nicholls et al. | 52/702 |

* cited by examiner

PRIOR ART

BRICK VENEER HEADER BRACKET

CROSS REFERENCES TO RELATED APPLICATIONS

This application claims priority from U.S. Provisional Application Ser. No. 61/848,273 filed on Dec. 29, 2012 which is incorporated by reference herein.

TECHNICAL FIELD

The present invention relates to brackets used to connect a deck to the outside wall of a house, particularly to a house covered with brick or stone veneer.

BACKGROUND OF THE INVENTION

Decks attached directly to houses are common in housing today. Decks are usually elevated above the ground and are supported by an exterior house wall and posts. Often, decks are over ten feet above the ground. Inadequate attachment of the deck to the exterior wall of the house can cause dangerous and even deadly consequences. Even when the deck is initially attached strongly enough to support a given load, incorrect deck attachment practices can lead to premature weakening of the attachment between the house and deck due to water damage and expansion and contraction caused by freezing and thawing in the winter and heat of summer days.

Traditionally, decks have been attached to houses with bolts attaching the deck ledger board to the brick, wood or concrete block wall of the house. The deck ledger is parallel to and should be fastened to the house rim board. However, in the interest of convenience or time savings, sometimes the deck ledger is attached directly to the brick, stone, or siding by screws or lag bolts. This form of attachment is sub-standard, weak, dangerous and against building codes. Brick or stone veneer should never be relied upon to support a load. There is an air gap between brick veneer and wall structure which must be maintained to prevent moisture problems on inner walls. Brick veneer is brittle and susceptible to cracking. Brick veneer is only intended to serve as covering and is no more reliable than aluminum or vinyl siding in terms of load support strength.

Improperly fastening the deck to the building can allow the connection between the house and deck to become weakened. Deck ledger boards are attached by nails to the house sometimes. Heat and cold can cause the ledger board to work away from the house. A large number of people moving around on a deck has a tendency to cause the ledger to pull away from the house and with only nails holding the ledger, the nails can and do slide within their holes. Deck ledger boards should be fastened with lag bolts at least, or better, with bolts and nuts with flat washers to spread the load over the boards. Screws can hold as much as ten times the pull force of similarly sized nails.

The brick is only a siding and should never support much of the load of a deck. Attachment of the deck should be through the house band joist or house foundation wall. The brick isn't attached to the house well enough to prevent a load shift and keep the deck from pulling away from the house altogether. Moreover, when bolting on the ledger they should not be tightened enough to crush the air space behind the brick wall.

DESCRIPTION OF THE RELATED ART

U.S. Pat. No. 6,397,552 by Bourque for DECK ATTACHMENT BRACKET AND METHOD OF ATTACHING A DECK TO A BUILDING which issued on Jun. 4, 2002 teaches an angle bracket including a vertical surface with holes for attachment to an exterior house wall, a horizontal surface with holes for attachment to the bottom surface of a deck ledger board and angled side braces connecting the vertical surface to the horizontal surface.

U.S. Patent Application Publication No. 20100307094 by Spyrou for BRICK BRACKET FOR INSTALLATION OF A LEDGER ON THE BRICK FACING OR VENEER OF A STRUCTURE AND ASSOCIATED METHODS FOR THE INSTALLATION OF THE BRICK BRACKET ON THE BRICK FACING which was published on Dec. 9, 2010 teaches a first vertical planar member with a first horizontal planar member extending from the front surface, a second vertical planar member extending downward from the outer edge of the first horizontal member. Two bolts and a second horizontal member extend forward from the bottom edge of the second vertical member. The deck ledger board rests on the top surface of the second horizontal member. The bolts extend through holes in the deck ledger and nuts rigidly fasten the ledger to the second vertical member. The first vertical planar member includes holes through which are installed lag bolts or bolts with nuts at the other end for fastening the first vertical member to a rim board of the house. The first horizontal planar member extends through the siding or brick veneer of the house.

U.S. Patent Application Publication No. 20050160683 by Eldeen for DECK BRACKET AND METHOD OF ATTACHING A DECK TO A BUILDING which published on Jul. 28, 2005 teaches an L-shaped bracket connected to a threaded horizontal rod. The other end of the rod is connected to a bracket which is rigidly fastened to a wall member of a house such as a stud or other vertical wall member. The L-bracket is held just outside the exterior wall of the house so that the deck ledger rests on the horizontal portion of the L-bracket and the rear vertical face of the ledger rests against the vertical member of the L-bracket. Bolts connect the ledger to the vertical portion of the L-bracket.

SUMMARY OF THE INVENTION

In accordance with the present invention, there is provided a device comprising, consisting of, or consisting essentially of a header bracket for attaching a deck ledger board to a house rim board including a first right angle member having a first rectangular flange rigidly attached to a second rectangular flange at a right angle along selected long edges thereof. A second right angle member has a third rectangular flange rigidly attached to a fourth rectangular flange at a right angle along selected long edges thereof. The first rectangular flange has at least two apertures for receiving rim board connecting bolts therein. The second rectangular flange has two slotted holes for adjustably receiving flange connector bolts wherein the slots are aligned perpendicular to the long edges. The third rectangular flange has two slotted holes for adjustably receiving flange connector bolts wherein the slots are aligned perpendicular to the long edges. The fourth rectangular flange has at least two apertures for receiving the deck ledger connecting bolts and at least two deck ledger connecting bolt and nut units including a means for locking nut and bolt threads.

The present invention is a U-bracket configured to be fastened to the exterior vertical side of the house rim board. The bracket comprises two right angle members connected by bolts. The two angle members have slots rather than holes for the bolts so that a user is able to adjust the U-bracket gap to a selected width, thereby accommodating house coverings of varying thicknesses with varying air spaces. Siding on the exterior of the house may require a U-bracket gap of only a couple of inches whereas a brick wall with an air space may require as much as five inches or so. When the selected gap is set, the connecting bolts are tightened to fix the gap.

One embodiment of the deck bracket includes mating surfaces of the two angle members which are knurled, striated, grooved or otherwise conditioned so that the two surfaces adjustably interlock with one another to reduce the chance of slippage between the two angle members after the connecting bolts are tightened.

One right angle member of the U-bracket is fastened to the house rim board with bolts with the channel of the U-bracket running vertically. The other right angle member of the U-bracket extending past the brick is attached to the outside of the deck ledger with bolts. Bolts extending through the deck ledger extend through the outer flange of the outer right angle member and are tightened securing the deck ledger board. Thus the deck ledger board is spaced apart from the house ledger removing the load from the block or brick.

Preferably, the deck bracket is attached to the rim board of the house before the siding or brick is installed, and then the deck is built. However, in an older house, the siding or brick may be removed in order to install the deck bracket. Later, the brick or siding may be re-installed.

The U-bracket comprises two angle members which are bolted together to form a U-shaped bracket. However, the two angle members may be rearranged to form a Z-shaped bracket as well. The resulting Z-bracket is likewise capable of connecting a deck ledger to a house rim board. In some situations and locations, a Z-bracket configuration is preferable to the U-bracket configuration. The bracket of the present invention provides which ever configuration is desired.

It is an object of this invention to provide a header bracket for fixedly connecting a deck ledger board to a house rim board.

It is an object of this invention to provide a header bracket which comprises two right angle members which are fastened together to form either a U-shaped bracket or a Z-shaped bracket for fixedly connecting a deck ledger board to a house rim board.

It is an object of this invention to provide a header bracket wherein the two right angle members are fastened with bolt and nut fasteners.

It is an object of this invention to provide a header bracket wherein the two right angle members include slotted holes for the bolt and nut fasteners so that the effective width of the bracket is adjustable, thus providing a gap between the deck ledger board and the house rim board which accommodates a house covering as thin as siding or as thick as brick veneer.

It is an object of this invention to provide a header bracket wherein the two right angle members include holes for bolts connecting the header bracket to the house rim board on the one side and to the deck ledger board on the other side of the bracket.

It is an object of this invention to provide a header bracket wherein the mating surfaces of the two right angle members are knurled, grooved, or striated so that when the connecting fasteners are tightened, the knurled or striated surfaces interlock together to form a more rigid connection which is resistant to slippage of the mating surface against one another.

It is an object of this invention to provide a header bracket wherein the at least two bolts are welded to one of the right angle members so that the deck ledger board can, after drilling holes for each bolt, be pressed onto the bolts and into place for installing and tightening nuts onto the bolts, thus making assembly easier.

It is an object of this invention to provide a header bracket including a plate member with holes which align with the holes in the right angle member, thus allowing the deck ledger board to be sandwiched between the right angle member and the plate for a more rigid attachment of deck ledger board to the header bracket.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein:

FIG. 5A is a left side perspective view of the two right angle members which are combined to form the header bracket including friction enhancing surfaces there between.

DESCRIPTION OF THE PREFERRED EMBODIMENTS

In accordance with the present invention, there is provided a header bracket 10 for attaching a deck ledger board to a house rim board.

Figure 1:
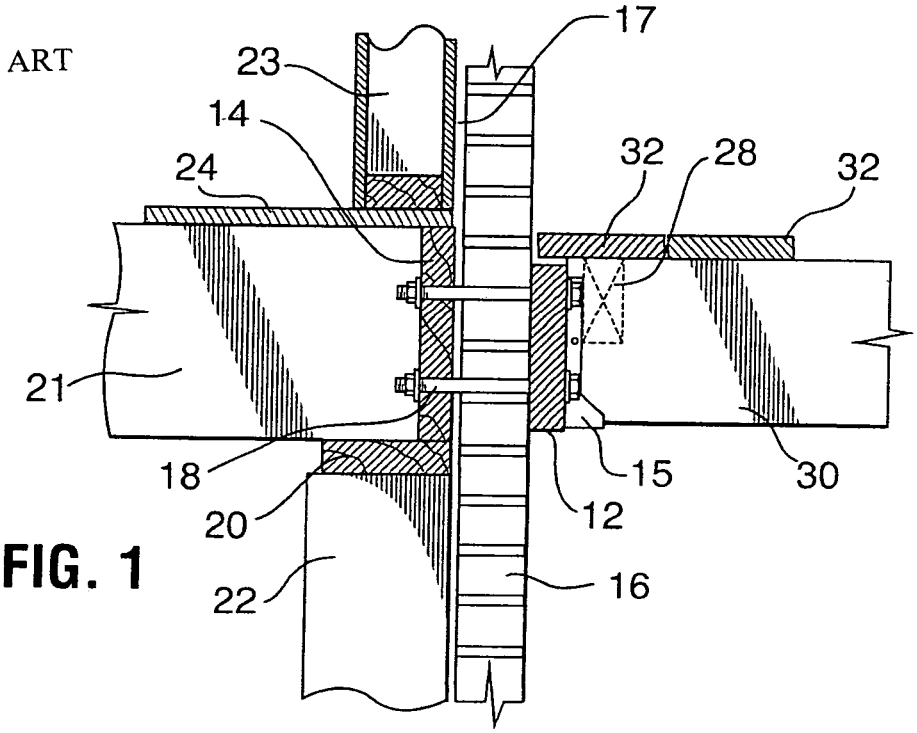
FIG. 1 PRIOR ART
FIG. 1 is a left side cross-sectional view showing attachment of a deck ledger board to a house rim board wherein the house is covered with brick veneer.
Figure 2:
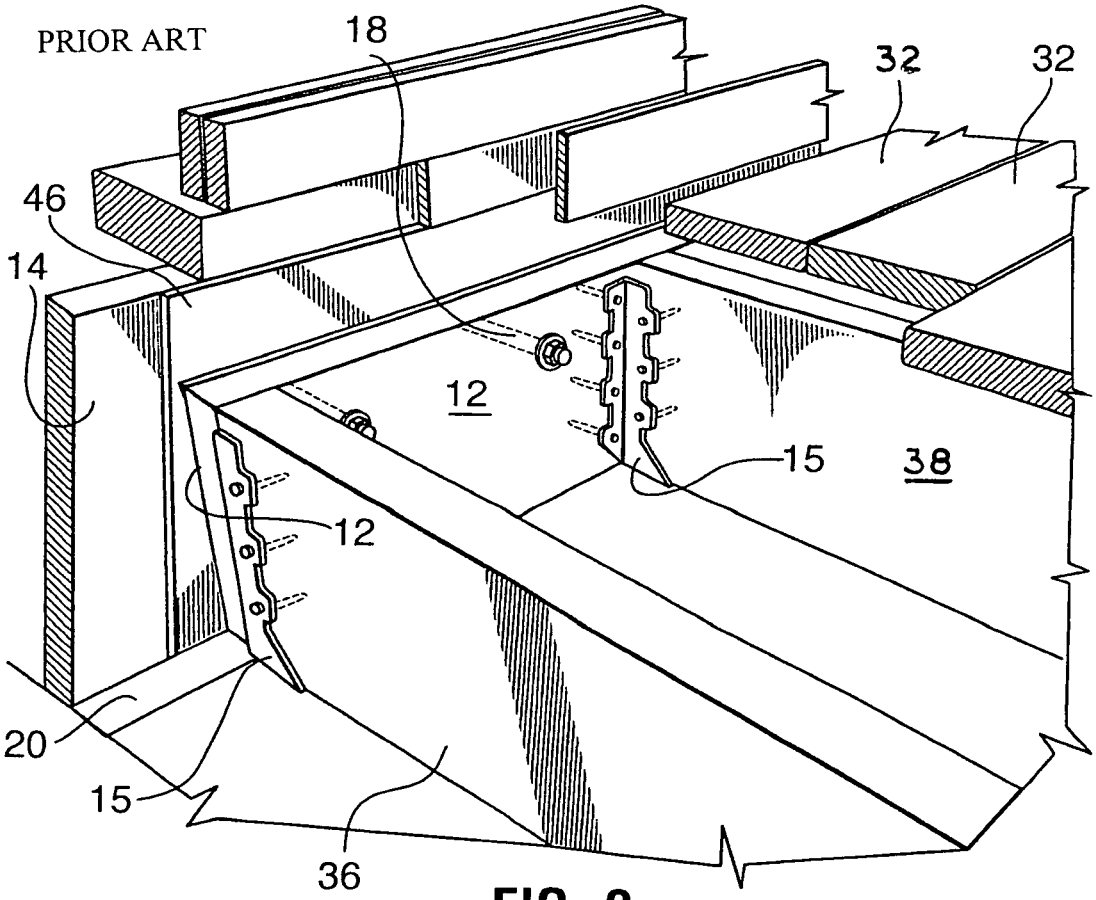
FIG. 2 is a left side perspective view showing attachment of a deck ledger board to a house rim board wherein the house is covered with siding.

As shown in FIGS. 1 and 2, a conventional method of connecting a deck ledger board 12 to a house rim board 14 is shown. Holes are drilled through the ledger board, flashing 46, bricks 16 (or other house covering) and the house rim board 14. Sleeve anchors or bolts 18 are disposed there through for holding the ledger board to the rim board. In FIG. 1, an air space 17 should be present between the bricks 16 and the inner wall to prevent rotting or water leakage through the brick and to the inner walls. Over tightening of the bolts 18 will pull the bricks toward and against the inner wall, resulting in two problems. Water may go through the brick veneer and contact and damage the inner wall. Second, and more important, the brick wall is now stressed and may become cracked and/or collapse. Conversely, if the bolts 18 are not tightened enough, the brick veneer is supporting the bolts 18 from underneath and therefore is supporting the load of the deck 30 resting on the rim joist 36 and common joist 38 of the deck whereby the hanger 15 attached to the deck ledger board 12 by the bolts extending through the brick 16 to the rim board 14. In addition, blocking 28 may be used to support the deck boards 32 if the decking is on an angle. Brick veneer is brittle and cracks easily. Consequently, relying on brick veneer to support a load is dangerous and is against building code. Therefore, it can be seen that the present invention is far superior to the standard practice of using bolts alone to connect a ledger board to a rim board, especially where brick veneer is used to cover the house.

As shown in FIGS. 3-8 a cross-sectional view of a deck installation with the house to the left side and the deck 30 extending to the right from the house. A sill plate 20 rests on the concrete foundation wall 22 of the house. A house band joist or rim board 14 lies upright along the outside upper edge of the sill plate 20. House floor joists 21 are connected perpendicularly to the inside face of the rim board. Sub-floor 24 supports stud 23 and is attached to the top surface of the floor joists 12 and the rim board 14. Wall members are attached to the top face to the sub-floor 24. The header bracket 10 connects deck ledger board 12 to rim board 14.

Figure 3:
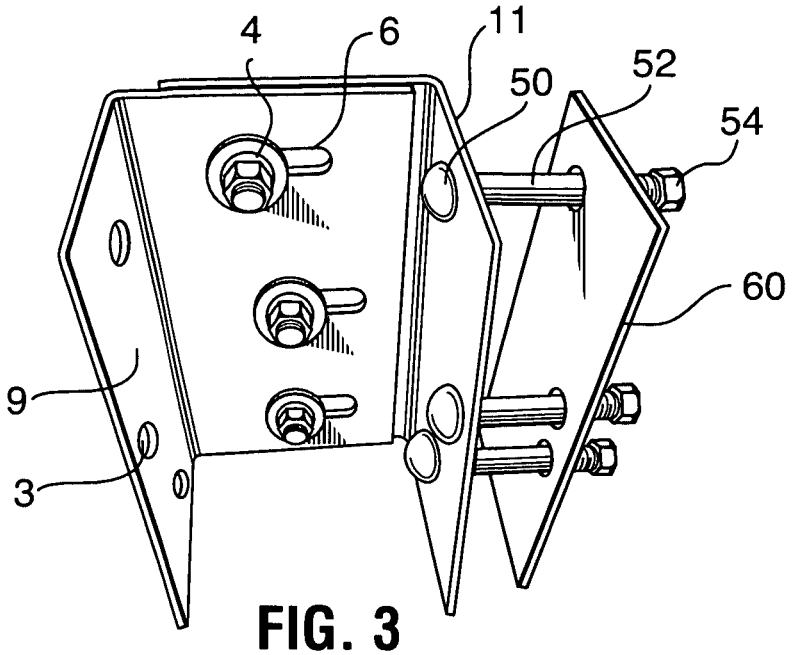
FIG. 3 is a perspective view of the header bracket of the present invention.
Figure 4:
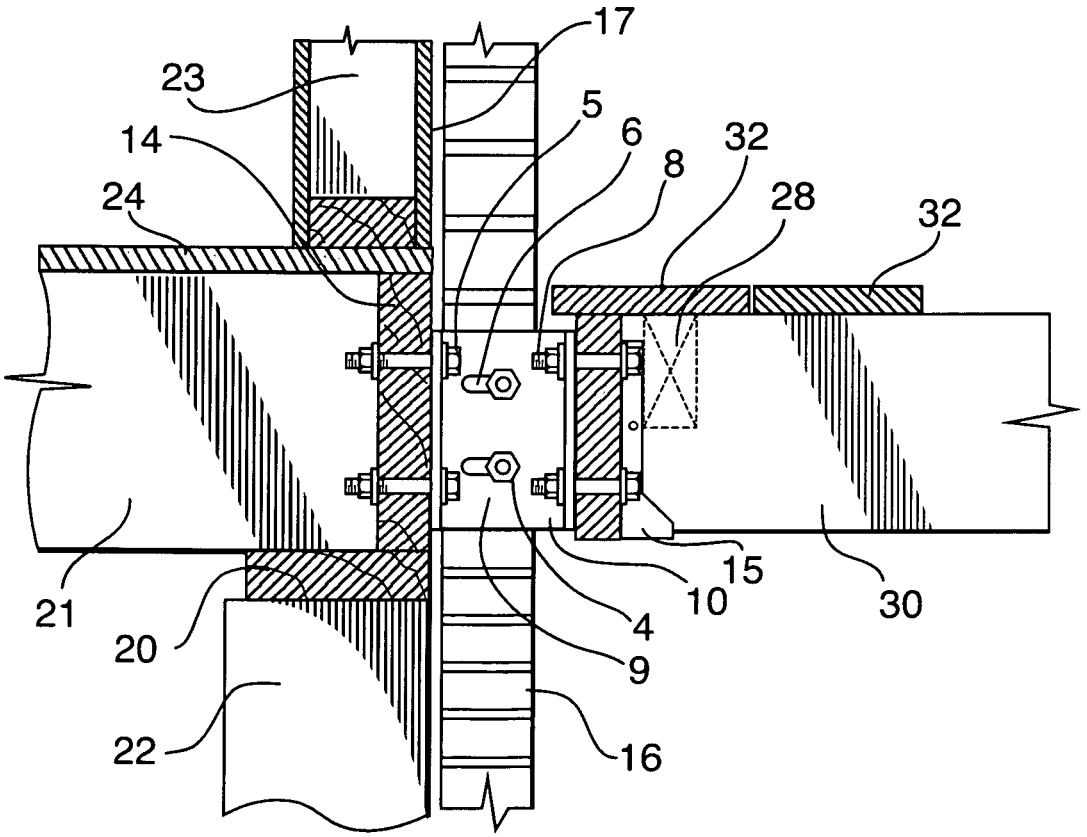
FIG. 4 is a left side cross-sectional view showing attachment of the deck ledger board to a house rim board using the header bracket wherein the house is covered with brick veneer.
Figure 4A:
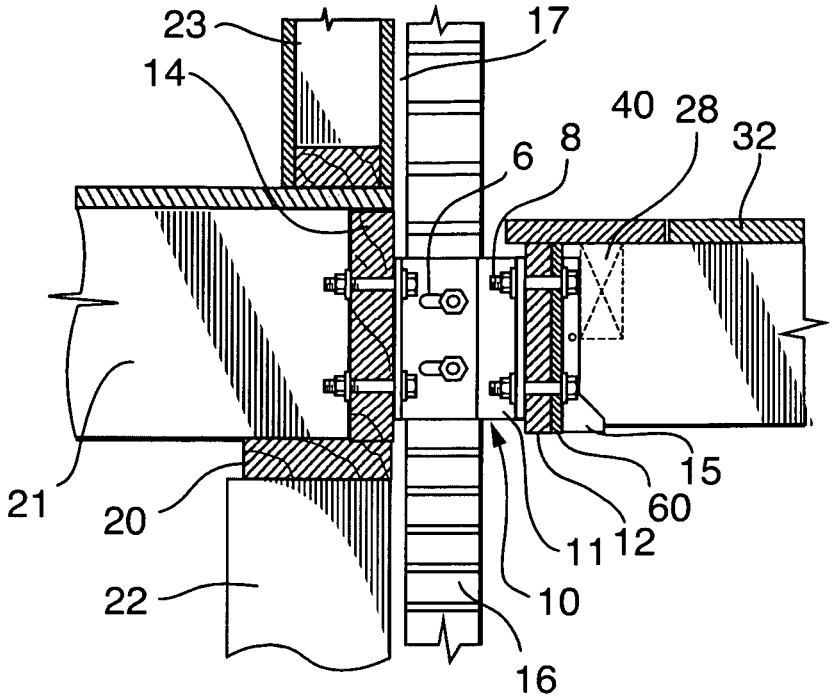
FIG. 4A is a left side cross-sectional view showing attachment of the deck ledger board to a house rim board using the header bracket together with a ledger plate sandwiching the deck ledger board between the outer face of the bracket and blate for a more rigid attachment wherein the house is covered with brick veneer.
Figure 5:
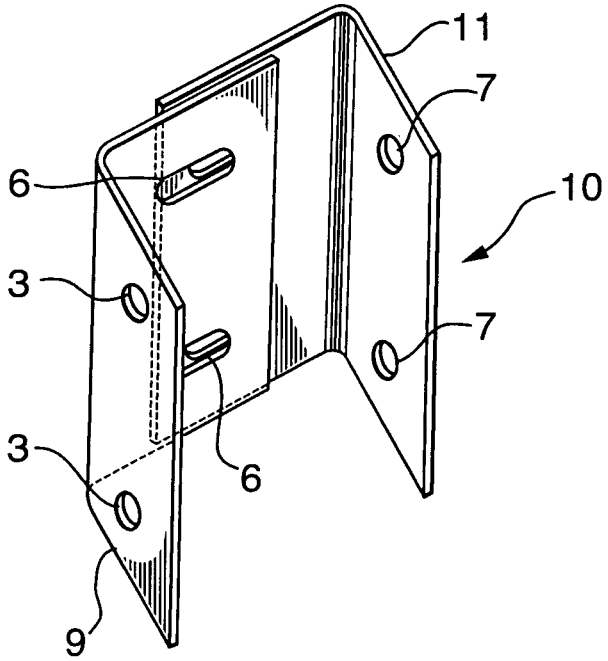
FIG. 5 is a left side perspective view of the two right angle members which are combined to form the header bracket.
Figure 5A:
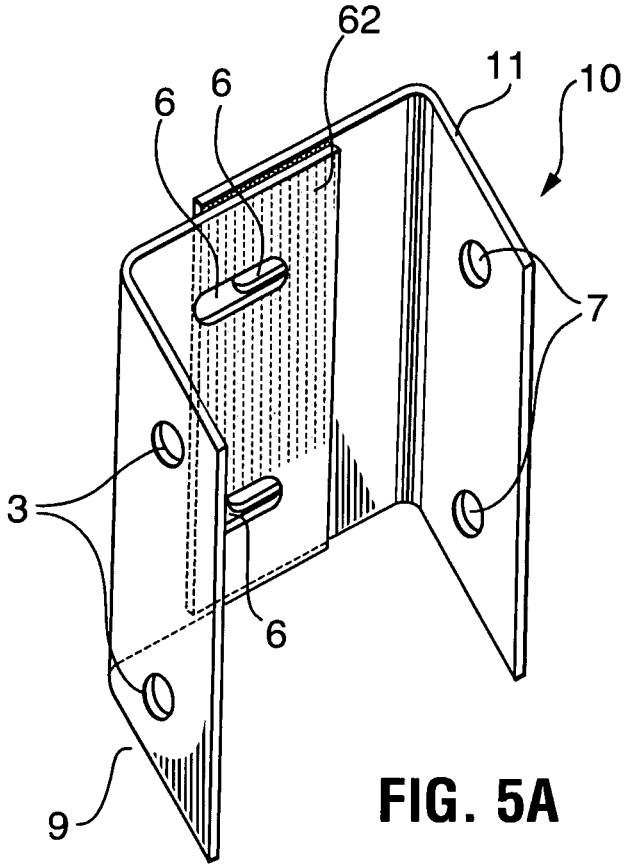

The header bracket 10 comprises two right angle members 9 and 11 held together with bolt and nut units 4 as shown in FIGS. 3 and 5. Header bracket 10 is configured as a U-bracket and is applied to the outer face of rim board 14 in an attitude wherein the channel of the U-bracket is situated vertically. Right angle member 9 of header bracket 10 contains at least two holes 3 for receiving bolts 5 which hold the header bracket 10 to the rim board 14. Holes are drilled through rim board 14 in alignment with the at least two holes 3 in angle member 9. Bolts 5 are inserted connecting the header bracket 10 to rim board 14 and nuts are installed and tightened.

Right angle member 11 is attached to right angle member 9 with at least two bolt and nut units 4. The at least two bolt and nut units 4 are held in horizontal slots 6 in right angle members 9 and 11 rather than holes so that the amount by which the deck ledger board 12 stands off from the house rim board 14 is adjustable. This adjustment allows a user to accommodate for differing thicknesses of exterior house covering, for example, siding, stucco, brick veneer, stone veneer, and so forth. With the desired stand-off distance set, the deck ledger board is attached to the outer face of the right angle member 11 with bolt and nut units 8. The deck is then completed.

FIG. 5 shows the header bracket 10 including right angle bracket 9 and 11, with rim board bolt holes 3, ledger board bolt holes 7 and connecting bolt slots 6, but not showing the connector bolts 4.

One embodiment of the present invention includes vertical grooves or striations on each of the mating surfaces of the right angle members. Shown in FIG. 5 are friction means comprising cross hatching or vertical grooves 62 on each of the mating surfaces of the right angle members 9 and 11, which interlock together to resist slippage of the mating surfaces with respect to one another.

Another embodiment of the present invention includes bolts which are permanently attached extending outward from the outer face of right angle member 11. The rigidly attached bolts 52 ease the attaching of the deck ledger board to the header bracket because the user does not have to hold the board with one hand while pushing bolts through the holes and installing nuts. The bolts 52 are preferably welded at the heads 50, or may be press fitted into the holes 7 of right angle member 11.

The header bracket may include a plate 60 which is installed over the ends of the bolts 52 before the nuts 54 are installed, thus sandwiching the deck ledger board 12 between the outer face of right angle member 11 and the plate 60 for a more rigid attachment.

Figure 6:
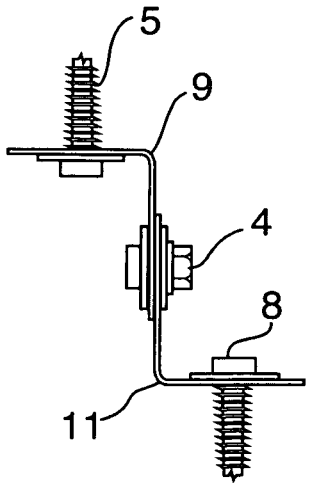
FIG. 6 is a top view of the header bracket configured in a Z-shaped configuration.

FIG. 6 shows the header bracket reconfigured in a Z-shaped form. Right angle member 11 has been inverted and then the slots 6 in each right angle member are aligned. The two right angle members 9 and 11 are then connected with bolts 4. This configuration may be necessary when connecting a deck to a house where there is some sort of obstruction which would not allow connection while using the U-shaped configuration.

A plurality of header brackets 10 are used to connect a deck ledger board to a house rim board. The spaced apart aligned brackets are adjusted and set to provide a gap 64 wide enough to install brick veneer between the deck and the house. The slim thickness of the bracket composed of 12 gauge metal is easy to hid within the brick seams. It is recommended that header brackets be placed on 16 to 24 inch centers to provide for ample load support.

The two right angle members 9 and 11 are preferably made from steel and are painted for outdoor use. The bolt and nut units 4, 5, and 8 are high grade steel. Alternately, the angle members and bolts may be stainless steel. Bolt and nut units 5 may be replaced with lag bolts. Bolt and nut units 4 preferably include a thread locking means like lock washers, self locking nuts or the application of thread lock on the bolt threads just prior to installation of the nuts.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

We claim:

1. A header bracket for attaching a deck ledger board to a house rim board consisting of:

a first right angle member, said first right angle member comprising a first rectangular flange rigidly attached to a second rectangular flange at a right angle, said first rectangular flange and said second rectangular flange attached along selected long edges thereof;

a second right angle member, said second right angle member comprising a third rectangular flange rigidly attached to a fourth rectangular flange at a right angle, said third rectangular flange and said fourth rectangular flange attached along selected long edges thereof;

said first rectangular flange having at least two apertures formed therein for receiving rim board connecting bolts therein;

said second rectangular flange having two slotted holes formed therein for adjustably receiving flange connector bolts therein, said slots aligned perpendicular to said long edges;

said third rectangular flange having two slotted holes formed therein for adjustably receiving flange connector bolts therein, said slots aligned perpendicular to said long edges;

said second rectangular flange and said third rectangular flange overlapping in a sliding cooperative engageable relationship providing a space therebetween of a selected distance for an outside covering of the house comprising a brick or other covering;

said fourth rectangular flange having at least two apertures formed therein for receiving said deck ledger board connecting bolts;

at least two deck ledger board connecting bolt and nut units including a means for locking mating nut and bolt threads; and wherein mating surfaces of said second rectangular flange and said third rectangular flange contain interlocking friction means for interlocking said second rectangular flange and said third rectangular flange in cooperative engagement upon tightening for supporting deck ledger board by said house rim board without exerting pressure on said outside covering of said house.

2. The header bracket defined in claim 1 wherein said means for locking said threads of said connecting bolts is selected from the group consisting of lock washers, self locking nuts, the application of thread lock on the bolt threads just prior to installation of the nuts, and combinations of the above.

3. The header bracket defined in claim 1 wherein bolts are rigidly attached in said at least two holes formed in said fourth rectangular flange, said bolts extending outward from an outside face of said fourth rectangular flange.

4. The header bracket defined in claim 1 further comprising a plate having at least two apertures formed therein, said apertures configured to align with said at least two apertures formed in said fourth rectangular flange.

5. The header bracket for attaching a deck ledger board to a house rim board of claim 1, wherein said bolts extending outward from an outer face of a selected right angle member are permanently affixed thereto.

6. The header bracket for attaching a deck ledger board to a house rim board of claim 1 wherein said friction means comprises grooves parallel to said long edges of said rectangular flanges.

7. A header bracket for attaching a deck ledger board to a house rim board consisting of:

a first right angle member, said first right angle member comprising a first rectangular flange rigidly attached to a second rectangular flange at a right angle, said first rectangular flange and said second rectangular flange attached along selected long edges thereof;

a second right angle member, said second right angle member comprising a third rectangular flange rigidly attached to a fourth rectangular flange at a right angle, said third rectangular flange and said fourth rectangular flange attached along selected long edges thereof;

said first rectangular flange having at least two apertures formed therein for receiving rim board connecting bolts therein;

said second rectangular flange having two slotted holes formed therein for adjustably receiving flange connector bolts therein, said slots aligned perpendicular to said long edges;

said third rectangular flange having two slotted holes formed therein for adjustably receiving flange connector bolts therein, said slots aligned perpendicular to said long edges;

said fourth rectangular flange having at least two apertures formed therein for receiving said deck ledger board connecting bolts;

at least two rim board connecting bolt and nut units including a means for locking mating nut and bolt threads;

said second rectangular flange and said third rectangular flange overlapping in a sliding cooperative engageable relationship providing a space therebetween of a selected distance for an outside covering of the house comprising a brick or other covering;

at least two deck ledger board connecting bolt and nut units including a means for locking mating nut and bolt threads, said bolts permanently affixed to and extending outward from an outer face of said second right angle member through said deck ledger board and a plate cooperatively engaging threaded nuts sandwiching said deck ledger board between said outer face of said second right angle member and said plate reinforcing same; and wherein mating surfaces of said second rectangular flange and said third rectangular flange contain friction means interlocking said second rectangular flange and said third rectangular flange together in cooperative engagement upon tightening.

8. The header bracket for attaching a deck ledger board to a house rim board of claim 7, wherein said friction means comprises interlocking grooves parallel to said selected long edges of said rectangular flanges.

* * * * *